United States Patent [19]

Johnson

[11] 4,170,297

[45] Oct. 9, 1979

[54] SHIPPING UNIT

[75] Inventor: Charles H. Johnson, Latta, S.C.

[73] Assignee: Packaging Corporation of America, Evanston, Ill.

[21] Appl. No.: 920,656

[22] Filed: Jun. 30, 1978

[51] Int. Cl.[2] ..... B65D 81/00; B65D 85/62

[52] U.S. Cl. ..... 206/326; 206/499; 206/588; 206/589

[58] Field of Search ..... 206/326, 320, 521, 586, 206/587, 588, 589, 591, 593, 499; 229/DIG. 3

[56] References Cited

U.S. PATENT DOCUMENTS

| | | | |
|---|---|---|---|
| 2,212,310 | 8/1940 | Wokosin | 206/326 |
| 2,410,591 | 11/1946 | Turner | 206/591 |
| 2,578,107 | 12/1951 | Thacker et al. | 206/592 |
| 3,313,467 | 4/1967 | Ankerskow et al. | 229/DIG. 3 |
| 3,338,501 | 8/1967 | Clay | 206/326 |
| 3,727,827 | 4/1973 | Stice | 229/DIG. 3 |

*Primary Examiner*—William T. Dixson, Jr.
*Attorney, Agent, or Firm*—Neuman, Williams, Anderson & Olson

[57] ABSTRACT

A shipping unit formed of foldable sheet material is provided for accommodating a pair of chairs arranged in inverted stacked relation. The unit includes an upright container having a bottom and side panels forming a chamber in which the pair of chairs is disposed. A first inner packing member is positioned within the chamber adjacent a lower corner thereof formed along one peripheral side of the bottom. The first inner packing member has a first means for snugly accommodating a segment of the back of the inverted one of the pair of chairs and second means for snugly accommodating the ends of the front legs of the upright one of the pair of chairs. A second inner packing member is positioned within the chamber adjacent an upper corner thereof wherein the inner packing members are diagonally disposed relative to one another. The second inner packing member is provided with a third means for snugly accommodating a segment of the back of the upright one of the pair of chairs, and a fourth means for snugly accommodating the ends of the front legs of the inverted one of the pair of chairs. The shipping unit is provided with means for closing the top of the chamber subsequent to the second inner packing member being positioned within the chamber.

9 Claims, 25 Drawing Figures

FIG. 23
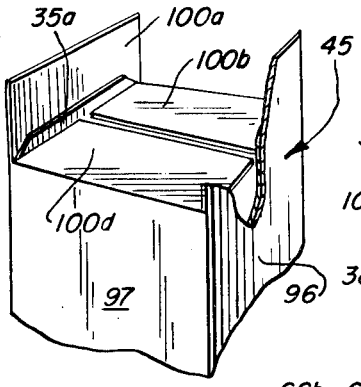
FIG. 24
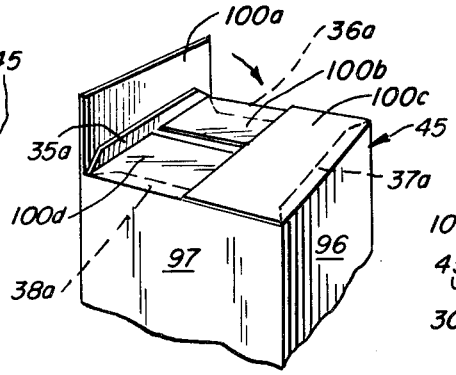
FIG. 25
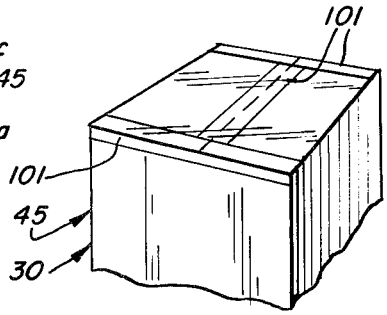
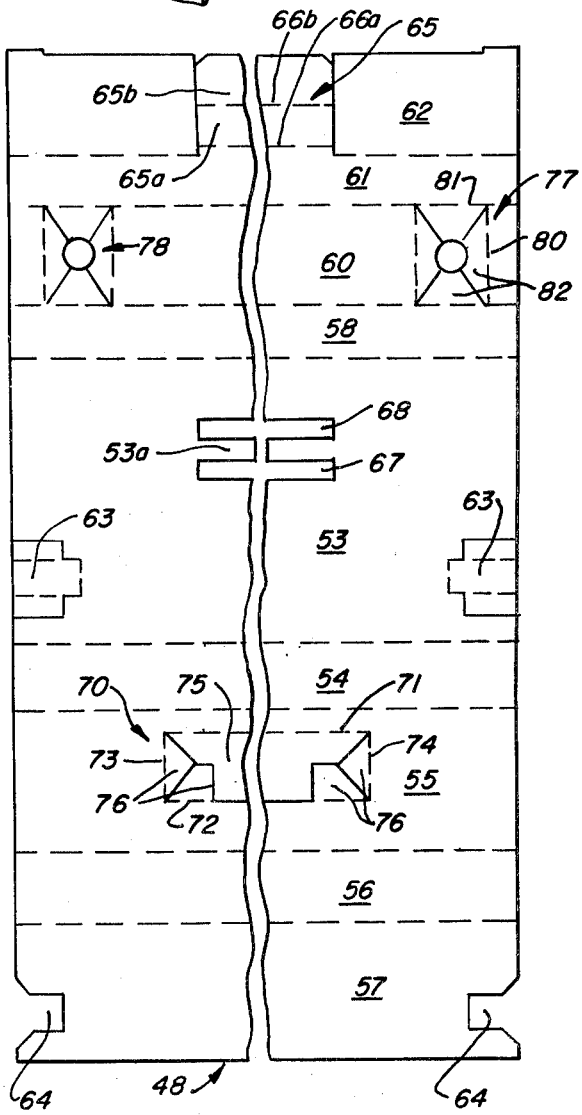
FIG. 8
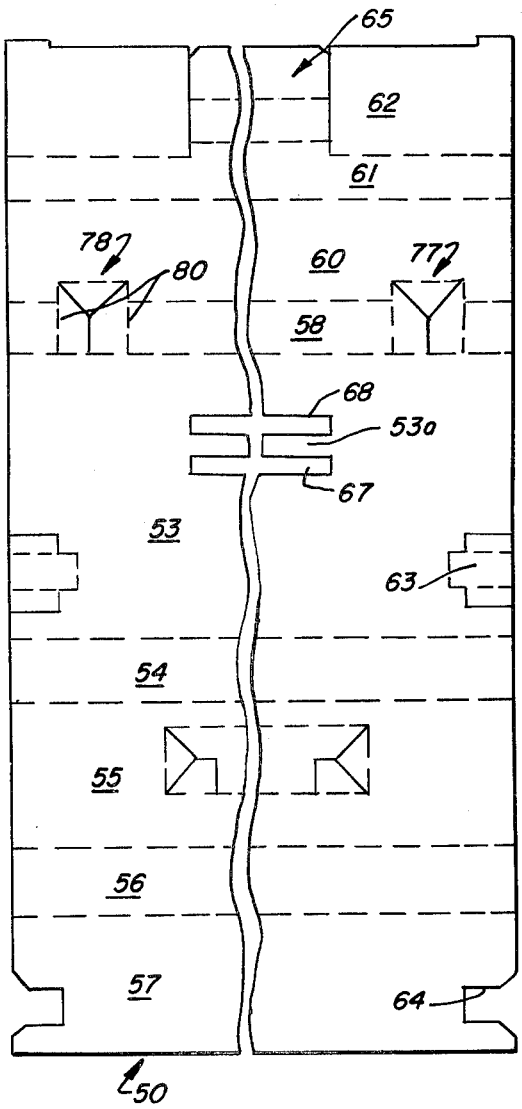
FIG. 9

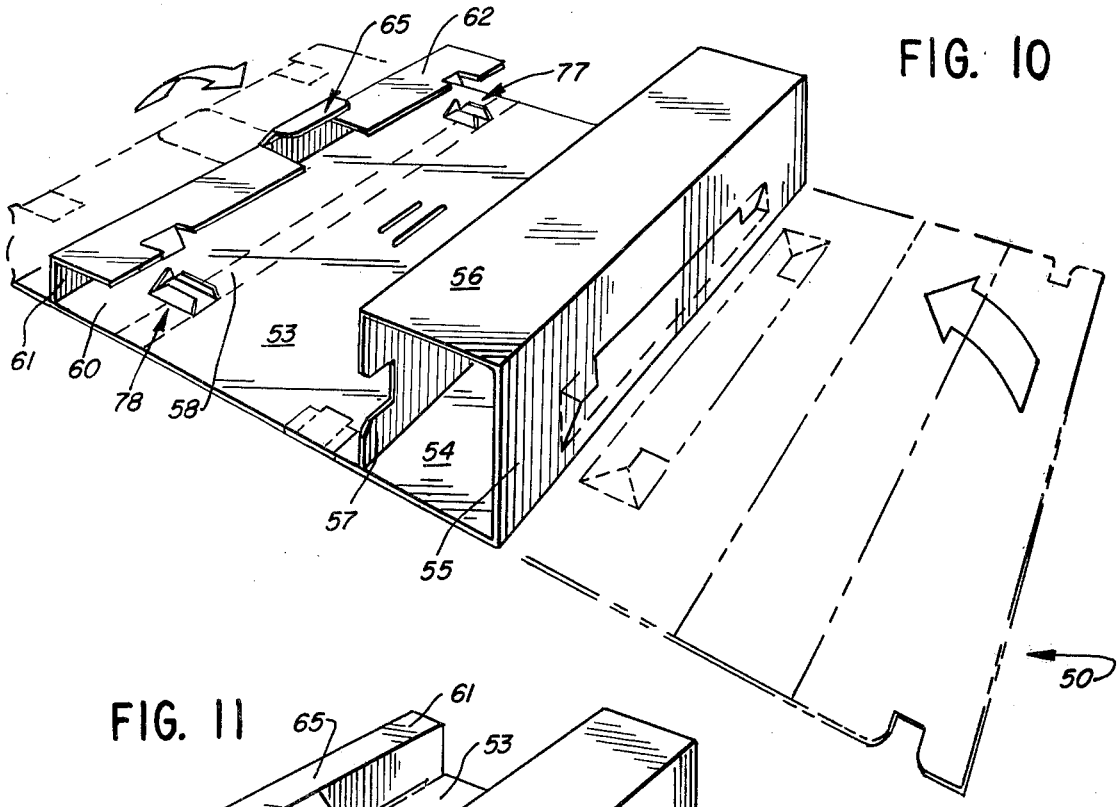
FIG. 10
FIG. 11
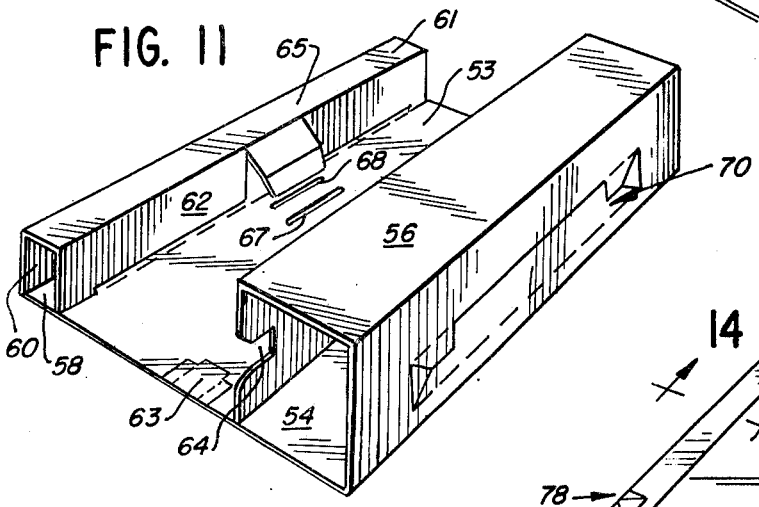
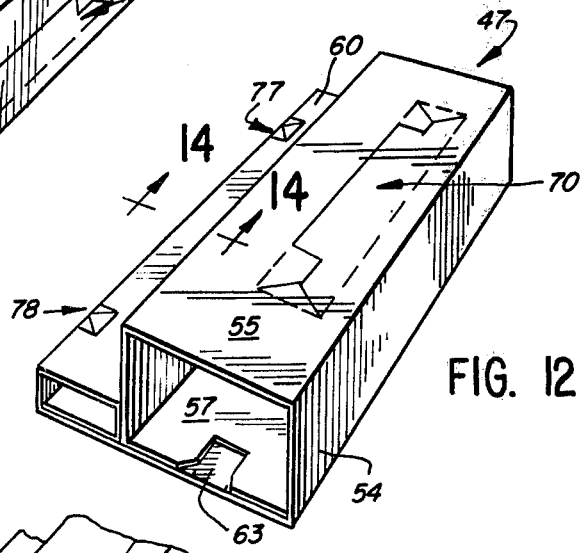
FIG. 12
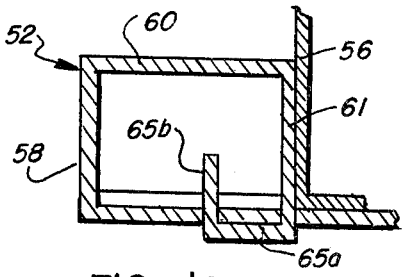
FIG. 14
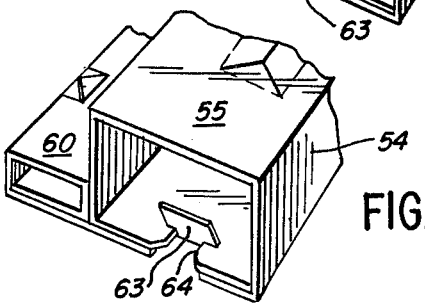
FIG. 13

FIG. 20
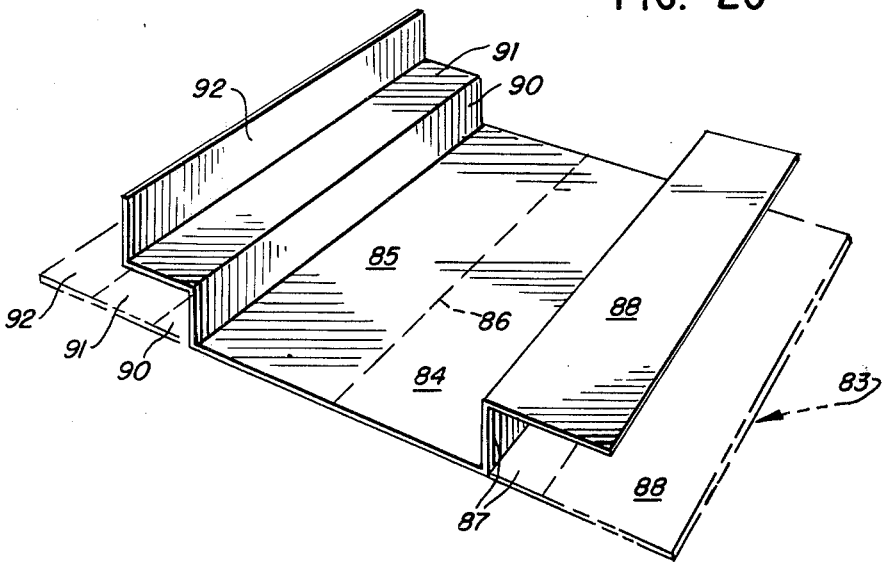
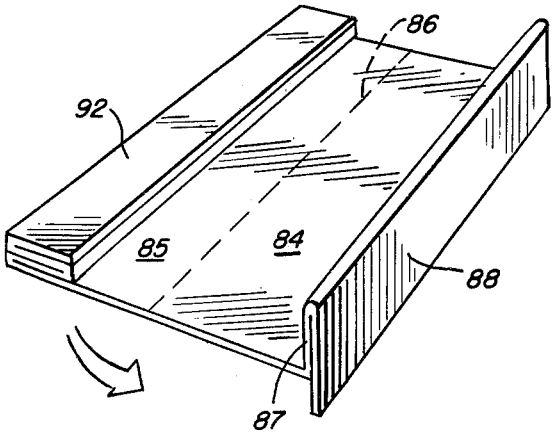
FIG. 21
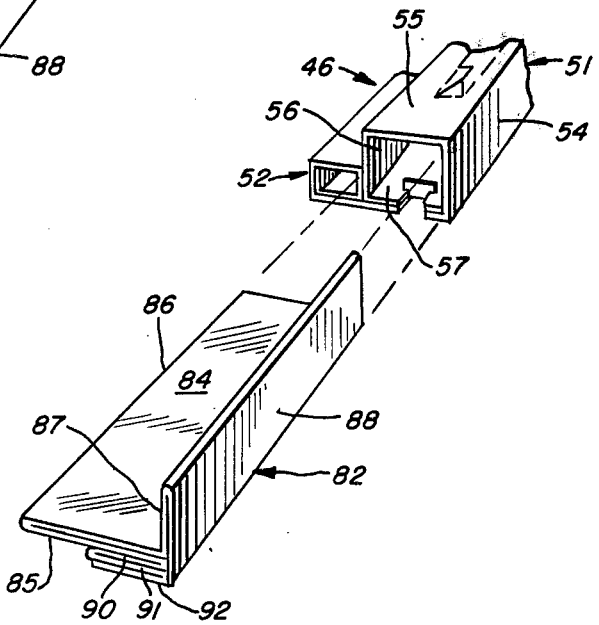
FIG. 22

SHIPPING UNIT

BACKGROUND OF THE INVENTION

Various shipping units have heretofore been provided for accommodating a pair of chairs, such as dining room chairs or the like; however, because of inherent design characteristics, such units were beset with one or more of the following shortcomings: (a) the unit required an inordinate number of components which were awkward and time consuming to assemble and involved substantial manual labor; (b) the unit utilized an excessive amount of cubic inches; (c) the unit was incapable of accommodating chair styles and sizes which varied over a wide range; (d) the unit was incapable of providing the necessary protection for the accommodated articles even when the unit was subjected to normal handling during shipping or storage; and (e) the unit embodied numerous specially designed components usable for only a specific style or size chair and, thus, required the packer to maintain a large inventory of the numerous components.

SUMMARY OF THE INVENTION

Thus, it is an object of the invention to provide a shipping unit which is of simple, yet sturdy construction, is versatile in accommodating chairs of widely varying styles and size, and provides effective protection for the accommodated chair even when the shipping unit is subjected to abusive handling.

Further and additional objects will appear from the description, accompanying drawings and appended claims.

In accordance with one embodiment of the invention a shipping unit is provided which includes a container having a closed bottom and upright side panels, all of which coact to form a chamber in which is disposed a pair of chairs arranged in inverted stacked relation. Disposed within the chamber and resting upon the bottom and engaging the lower interior surfaces of one side panel and a pair of panels extending from opposite side edges of the one side panel is a first inner packing member. The packing member is provided with a first means which is adapted to snugly accommodate a segment of the back of the inverted one of the pair of chairs. A second means is provided on the first inner packing member which is adapted to snugly accommodate the ends of the front legs of the upright one of the pair of chairs. A second inner packing member is also provided within the chamber which is disposed adjacent the top of the chamber and engages the upper interior surfaces of a second side panel opposite the said one side panel and the pair of side panels extending angularly from the opposite side edges of the second side panel. Similar to the first inner packing member, the second inner packing member is provided with a means for snugly accommodating a segment of the back of the upright one of the pair of chairs. A second means is also provided on the second inner packing member for snugly accommodating the ends of the front legs of the inverted one of the pair of chairs. Subsequent to the pair of chairs being disposed within the chamber and accommodated by the inner packing members, a means is provided for closing the top of chamber.

DESCRIPTION

For a more complete understanding of the invention reference should be made to the drawings wherein:

FIGS. 8 and 9 are fragmentary top plan views of blanks for the lower and upper inner packing members, respectively, shown in FIG. 5.

FIGS. 10–13 are perspective views showing the blank of FIG. 9 in various stages of setup to form the upper inner packing member seen in FIG. 5.

FIG. 14 is a fragmentary sectional view taken along line 14—14 of FIG. 12.

FIGS. 20–21 are perspective views showing various stages of setup for a reinforcing element which is assembled with at least the lower inner packing member.

FIG. 22 is a fragmentary perspective view showing how the setup reinforcing element is to be assembled with the lower inner packing member.

FIGS. 23–25 are fragmentary perspective views showing how the top closure component is assembled on the loaded container.

Figure 5:
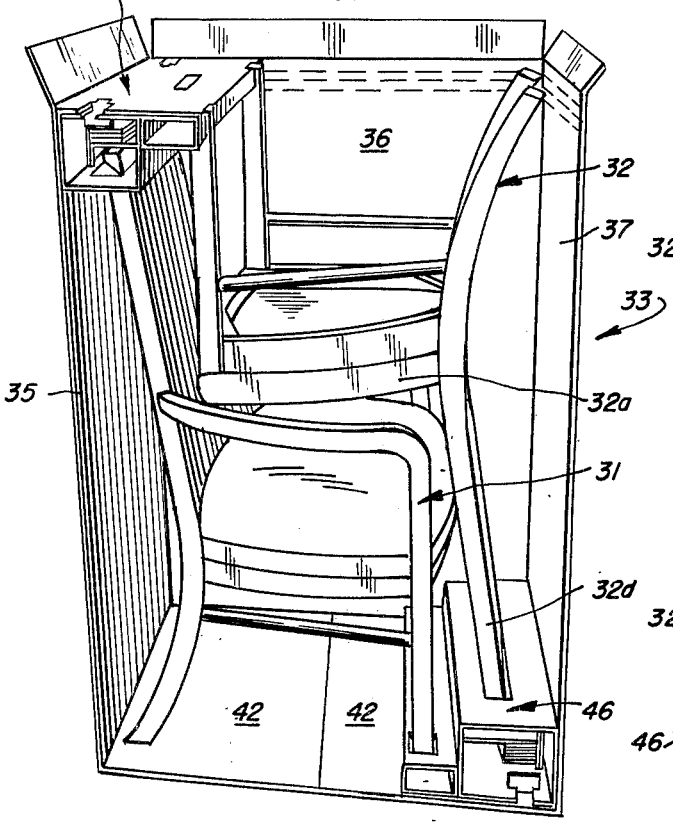
FIG. 5 is a fragmentary perspective side view of the container with one side panel thereof removed so as to show the arrangement of the pair of chairs and the inner packing members disposed therein.
Figure 7:
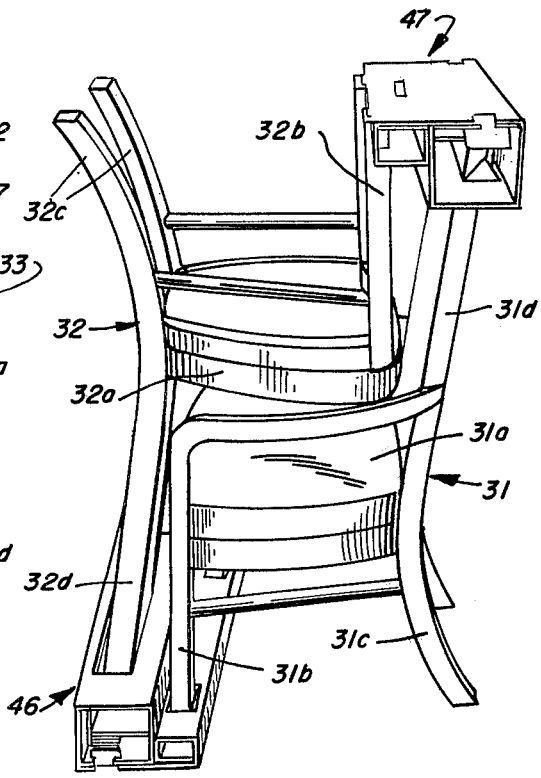
FIG. 7 is a perspective side view of the pair of chairs and associated inner packing members removed from the container of FIG. 5.

Referring now to the drawings, an improved shipping unit 30 is shown which is particularly suitable for accommodating either a single chair or a pair of chairs 31, 32, the latter as seen in FIGS. 5 and 7 being arranged in inverted stacked relation. The unit will be hereinafter described with respect to a pair of chairs. In the illustrated embodiment, chair 31 is a dining room type with armrests and chair 32 is basically the same type without armrests. It should be noted, however, that the pair of chairs may consist of two armchairs or two chairs without armrests.

Each chair of the pair of chairs is shown to be of conventional design and includes a seat section 31*a*, 32*a*, which may be cushioned if desired; front legs 31*b*, 32*b* and rear legs 31*c*, 32*c* depending therefrom; and a back section 31*d*, 32*d* extending upwardly from the seat section; the back section may be contoured slightly, if desired. Chair 31 also includes a pair of armrests 31*e* which interconnect the back section 31*d* to the front legs 31*b*.

Figure 1:
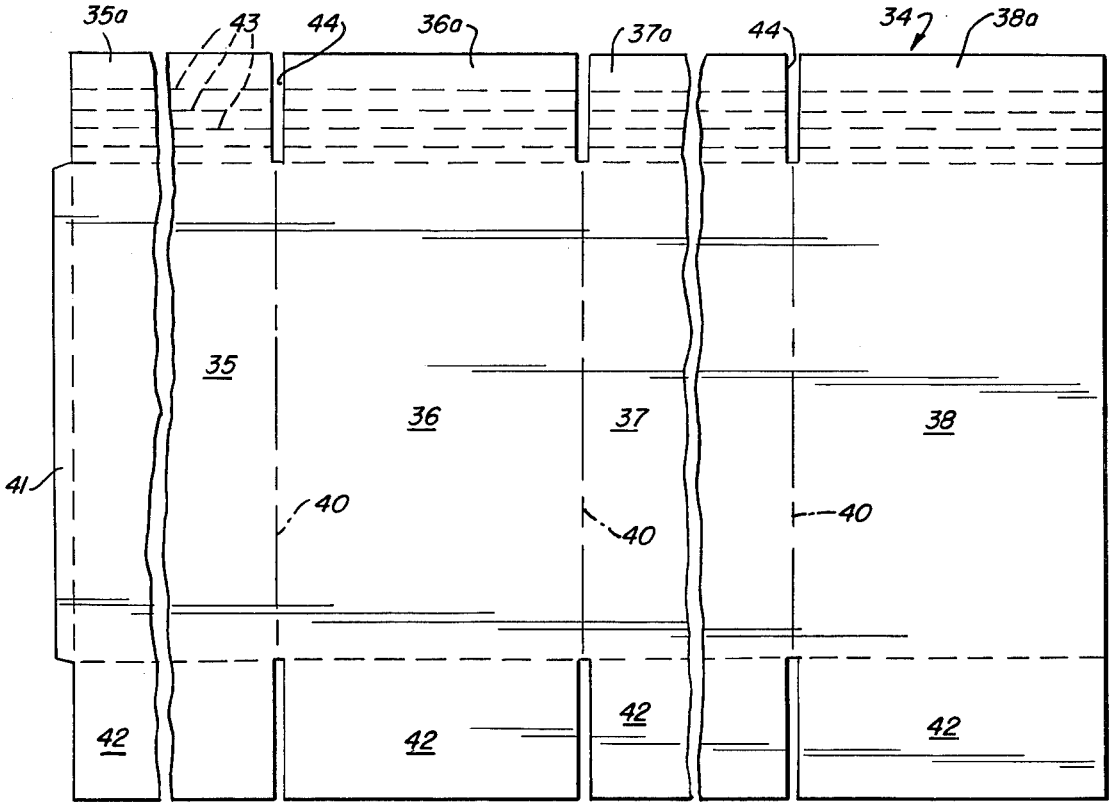
FIG. 1 is a plan view of one embodiment of a blank for the container of the improved shipping unit.

The pair of chairs 31, 32 are disposed within a container 33 formed from a blank 34 of foldable sheet material (e.g., double-faced corrugated fibreboard). The blank, as seen in FIG. 1, includes four side panels 35, 36, 37 and 38 arranged in side-by-side relation and foldably connected to one another by spaced parallel foldlines 40. A conventional glue flap 41 is foldably connected to side panel 35 and conventional bottom closure flaps 42 are foldably connected to the corresponding bottom edges of the side panels.

If desired, the upper portions of the side panels may be provided with a plurality of transverse foldlines 43 which are arranged in vertically spaced, substantially parallel relation. The upper portions of the side panels are separated from one another by elongated slots 44, each of which is aligned with the foldline 40. By reason of the transverse foldlines 43 and the slots 44 the container 33 may readily accommodate a pair of stacked chairs of varying heights. The segment 35*a*, 36*a*, 37*a*, 38*a* of the upper portion of each side panel which projects above the accommodated pair of chairs is folded inwardly when the top closure component 45 is secured to the container in a manner to be described more fully hereinafter.

Figure 2:
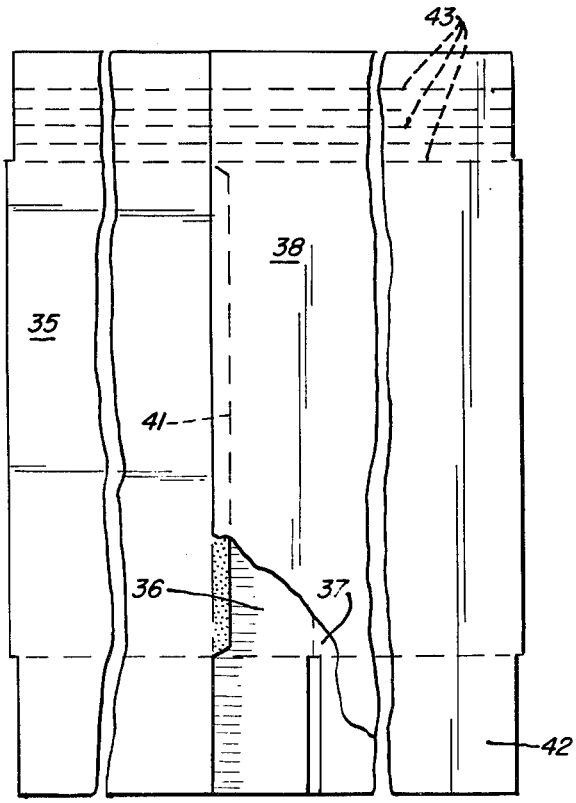
FIG. 2 is a plan view of the container formed from the blank of FIG. 1 and showing the container in a collapsed state.

Prior to the container 33 being loaded, it may be stored in a collapsed state as seen more clearly in FIG. 2. The size and shape of the side panels and closure flaps may vary from that shown and will depend upon the shape and size of the chairs intended to be accommodated in the shipping unit.

As seen in FIG. 5, the lower portion of the depending back section 32*d* of the inverted chair 32, and the ends of the front legs 31*b* of the upright chair 31 are snugly accommodated by a lower inner packing member 46. In a similar manner, the upper portion of the back section 31*d* of the upright chair 31 and the upwardly protruding ends of the front legs 32*b* of the inverted chair 32 are snugly accommodated by an upper inner packing member 47. Each packing member 46, 47 is formed from a blank 48 (FIG. 8), 50 (FIG. 9), respectively, of foldable sheet material (e.g., double-faced corrugated fibreboard). The blanks 48, 50 are the same except for a minor structural detail which will be pointed out hereinafter. In view of this fact, therefore, only packing member 46 and the blank 48 thereof will be described in detail; however, corresponding portions of the two members and blanks will be given like numbers.

Figure 17:
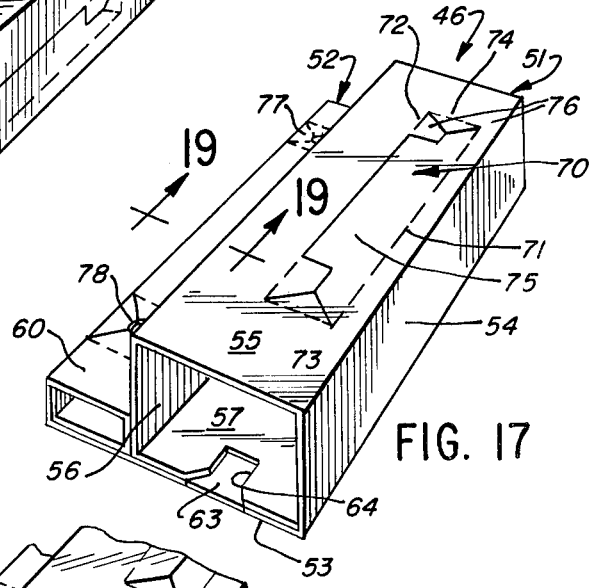

As seen in FIG. 17, member 46 includes a pair of elongated tubular sections 51, 52 which are disposed in contiguous, coextensive relation. The length of each tubular section corresponds to the width of side panel 35, 37 so that the ends of the sections 51, 52 slidably engage the interior surfaces of opposing side panels 36, 38 when the member is positioned within the chamber C, the latter being formed by the bottom closure flaps 42 and the upstanding side panels 35–38. Tubular section 51 is the taller of the two sections and in the case of member 46, engages the lower interior surface of side panel 37 and in the case of member 47 engages the upper interior surface of side panel 35.

Blank 48 includes a center panel 53 which engages and is supported by the bottom of chamber C. Foldably connected to one side edge of panel 53 is a relatively narrow panel 54 to which in turn is foldably connected a panel 55. A narrow panel 56 of the same configuration as panel 54 is foldably connected to the side edge of panel 55. In a similar manner a panel 57 is connected to panel 56. When the blank 48 is set up to form tubular section 51, panel 57 forms the bottom thereof and is subtended by a segment of center panel 53; panels 54, 56 form upright parallel sides; and panel 55 forms the top of said section, see FIG. 17.

Foldably connected to the opposite side of center panel 53 are the panels which form tubular section 52; namely narrow side panel 58, top panel 60, narrow side panel 61 of the same configuration as panel 58, and bottom panel 62.

In order to retain the panel components of tubular section 51 in a setup state, center panel 53 is provided with a pair of oppositely disposed peripheral tabs 63 which are struckout from the panel 53 and interlock with a pair of peripheral slots 64 formed in bottom panel 57.

Tubular section 52, on the other hand, is retained in a setup state by a large tab 65 formed centrally of bottom panel 62, see FIG. 8. It will be noted that the tab 65 extends the full width of panel 62 and is provided with a pair of foldlines 66*a*, 66*b* which extend transversely across the tab 65. The foldlines 66*a*, 66*b* define tab 65 into an inner segment 65*a* and an outer segment 65*b*. Foldline 66*a* is offset outwardly a slight amount from the foldline connecting panels 61, 62 so as to compensate for the thickness of the sheet material from which the blank 48 is formed.

Figure 19:
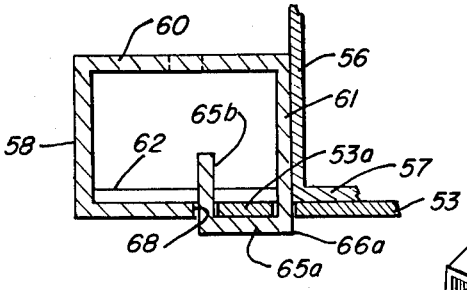
FIG. 19 is a fragmentary sectional view taken along line 19—19 of FIG. 17.
Figure 18:
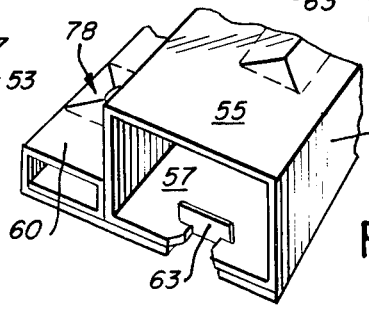

When tubular section 52 is set up, tab 65 is inserted through a slot 67 formed in center panel 53 whereupon, as seen in FIG. 19, inner segment 65*a* is then folded about foldline 66*a* so as to subtend a portion 53*a* of the center panel 53 and outer segment 65*b* is folded upwardly about foldline 66*b* and inserted through a second slot 68 formed in center panel 53.

In lieu of the tab 65 and slots 67, 68, a slot and tab arrangement such as described for tubular section 51 may be utilized, if desired, for tubular section 52.

As seen in FIG. 17, the top panel 55 of tubular section 51 is provided with an elongated pocket 70 which is adapted to snugly accommodate the lower end limit of the depending back section 32*a* of the inverted chair 32 of the pair of stacked chairs disposed within the chamber C. Pocket 70 is defined by a pair of elongated foldlines 71, 72 and a pair of short foldlines 73, 74. Foldline 72 is interrupted by a slit which forms the distal edge of a struckout flap 75. End struckout flaps 76 are also provided at opposite ends of flap 75, see FIG. 8, and coact with flap 75 to snugly engage the end limit of the inverted chair back section when the latter is accommodated in the pocket 70.

Panel 60, which forms the top panel of tubular section 52, is provided with a pair of laterally spaced pockets 77, 78 which are adapted to snugly accommodate the ends of the front legs 31*b* of the upright chair 31, see FIG. 5. Each pocket 77, 78 is of like construction and is delimited by a plurality of foldlines 80, 81 which in turn form the foldlines for a plurality of struckout flaps 82. When the ends of the front legs 31*b* are accommodated in pockets 77, 78 the flaps thereof coact to resiliently engage the inserted leg ends.

Figure 6:
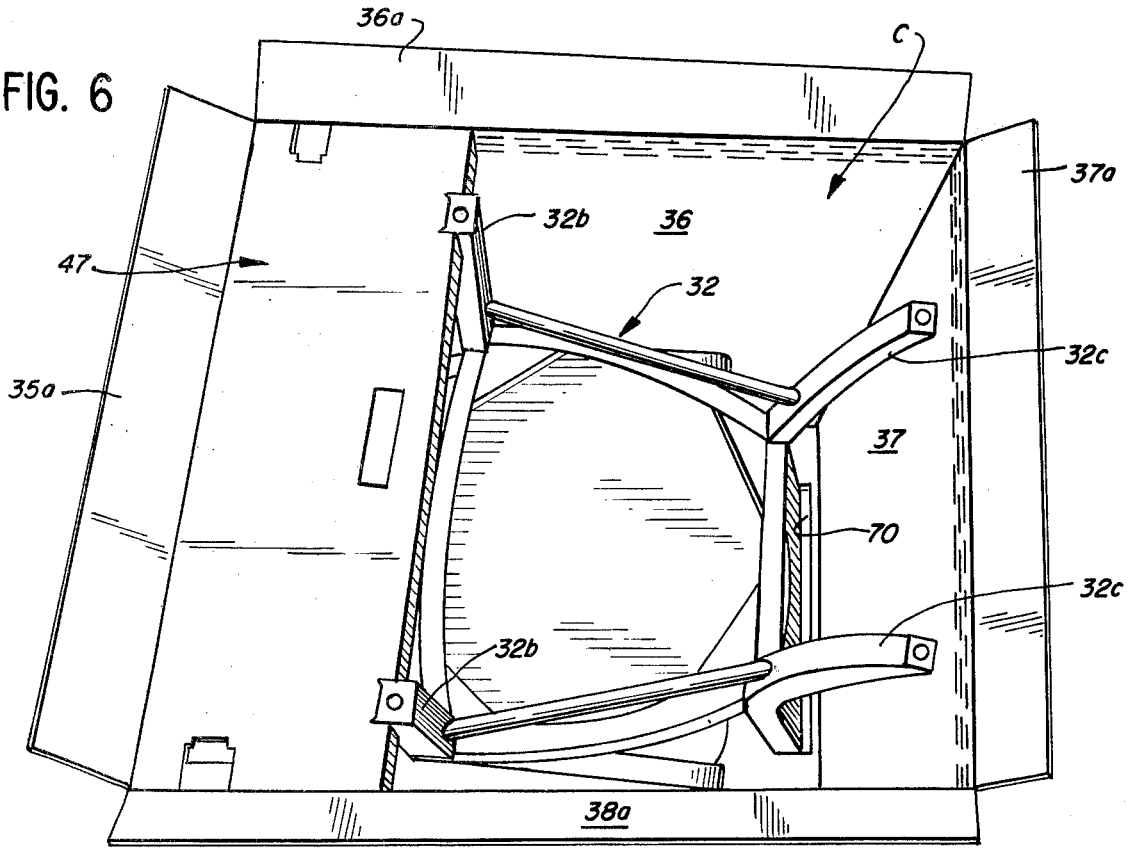
FIG. 6 is a fragmentary enlarged perspective top view of the loaded container of FIG. 5.
Figure 15:
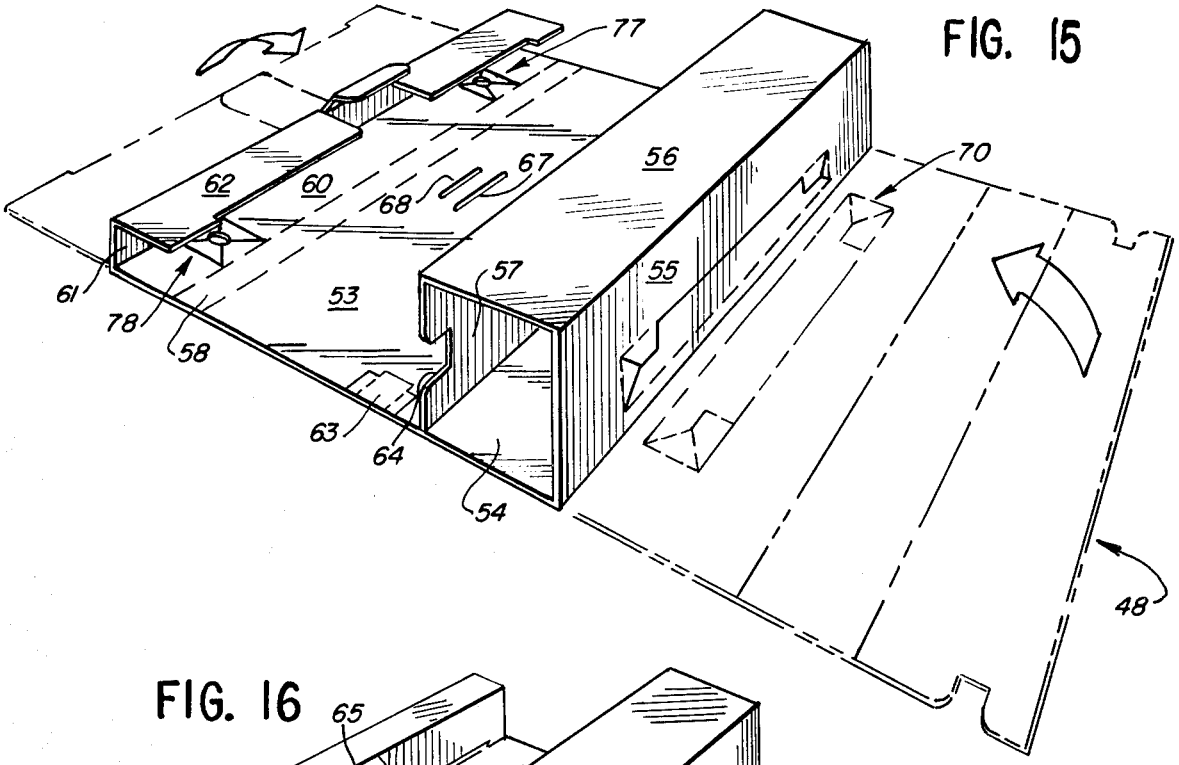
FIGS. 15–18 are similar to FIGS. 10–13 but relating to the blank of FIG. 8 for the lower inner packing member.
Figure 16:
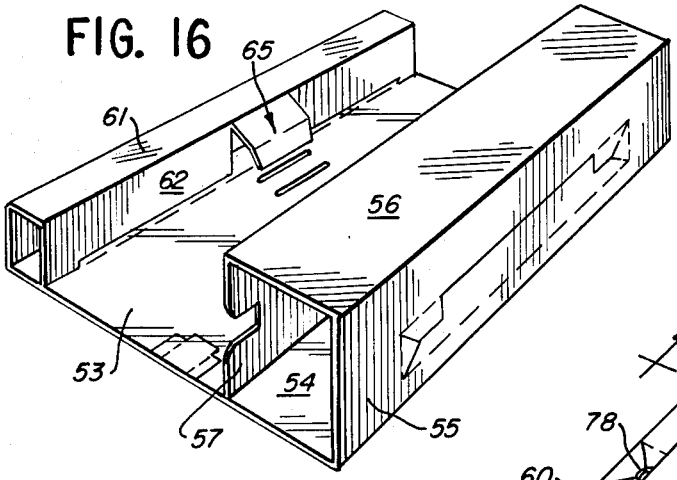

As previously mentioned, the inner packing members 46, 47 are of like construction except as to one structural feature; namely, the location and configuration of the laterally spaced pockets 77, 78 formed in the upper packing member 47. In place of the pockets 77, 78 being substantially centered with respect to the width of panel 60, as seen in the blank 48 of FIG. 8, the pockets 77, 78 formed in blank 50 of FIG. 9 are offset and extend into both panels 58, 60. Foldlines 80 which partially delimit the pockets extend from panel 60 and across the full width of panel 58. The reason for this arrangement is readily apparent when viewing FIGS. 5-7; namely, to enable the leg ends to move transversely of panel 58 when the packing members are being assembled with respect to the stacked chairs, as will be described more fully hereinafter.

The large tubular section 51 of at least the lower inner packing member 46 is preferably reinforced by an elongated piece 82, see FIG. 22, which is inserted endwise into the packing member 46 prior to the latter being assembled with the stacked chairs 31, 32. Piece 82 is formed from a blank 83 of sheet material and includes a pair of center panels 84, 85 connected to one another by a foldline 86. Connected to the opposite side of panel 84 is an intermediate panel 87 to which in turn is connected an outer panel 88.

Connected in a similar manner to the opposite edge of center panel 85 are a pair of intermediate panels 90, 91 and an outer panel 92.

FIGS. 20 and 21 show successive steps in setting up piece 82 from the blank 83. Intermediate panel 87 and outer panel 88 are folded relative to one another into face-to-face relation and then positioned at a right angle with respect to center panel 84. Outer panel 88 has a greater width than the intermediate panel 87 so that panel 88 extends upwardly and downwardly relative to panel 84. The width of outer panel 88 corresponds substantially to the interior vertical dimension of tubular member 51.

Panels 90, 91, 92, on the other hand, are folded relative to one another into a face-to-face superposed relation so as to overlie center panel 85, see FIG. 21, whereupon the panel 85 with the panels 90-92 stacked thereon is folded under the other center panel 84. The thickness of center panel 85 plus the combined thicknesses of the stacked panels 90-92 substantially equal the extent to which panel 88 depends from the center panel 84 when blank 83 is set up to form the reinforcing piece 82.

When piece 82 is assembled within tubular section 51, the elongated edge formed by foldline 86 will slidably engage the interior surface of panel 56 of section 51, and the exterior surface of panel 88 will slidably engage the interior surface of panel 54 of section 51. In addition to panels 54, 56 of the tubular section 51 being engaged by portions of piece 82, the upper and lower elongated edges of panel 88 will simultaneously slidably engage, respectively, panels 55, 57 of the tubular section 51.

When the lower portion of the depending back **32*d* of the inverted chair 32 is accommodated within pocket 70, it will engage the upper surface of the center panel 84 of the reinforcing piece and be supported thereby. Because of the folded superposed panels 90-92 being disposed beneath panel 84, the supporting strength of panel 84** is significantly increased.

Figure 3:
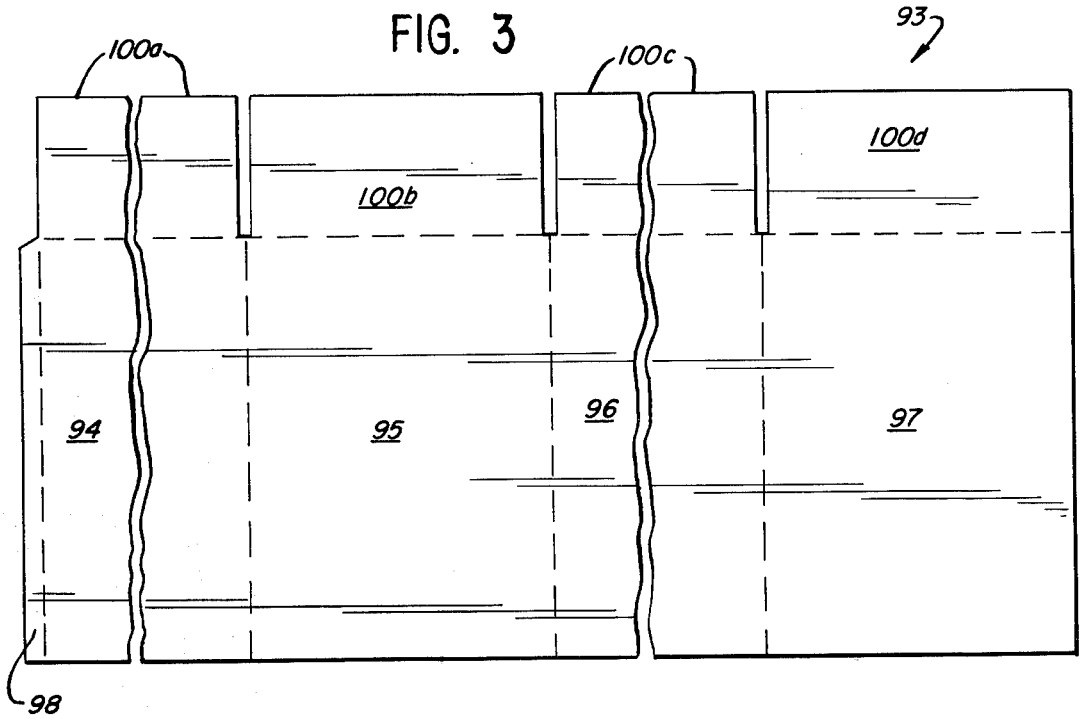
FIG. 3 is a plan view of one embodiment of a blank from which is formed a closure component for the container.
Figure 4:
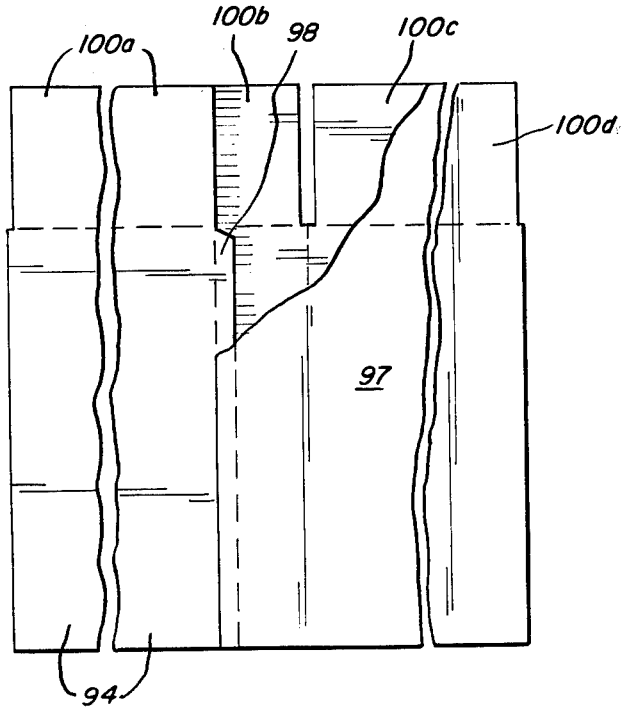
FIG. 4 is a plan view of the closure component formed from the blank of FIG. 3 and showing the component in a collapsed state.

FIG. 3 illustrates a blank 93 of foldable sheet material which sets up to form the top closure component 45 for the container 33. The illustrated embodiment of component 45 is that of a conventional telescope half slotted box. Blank 93 includes wall panels 94, 95, 96 and 97 which are disposed in side-by-side relation with adjacent panels being foldably connected to one another. A conventional glue flap 98 is foldably connected to panel 94. To the upper edges of the wall panels are foldably connected closure flaps **100*a*, 100*b*, 100*c* and 100*d***.

The configuration of panels 94-97 conform substantially to the respective side panels 35-38 of the container blank 34, so that the wall panels of the component 45 will snugly and slidably engage the exterior surfaces of the side panels of the container when the component is telescoped over the open top of the container.

As seen in FIGS. 23-25, when component 45 is assembled on the container 33, the side panels of the container are concealed by the wall panels of the component 45. The projecting segments **35*a*, 36*a*, 37*a*, and 38*a* of the container 33 engage the interior surfaces of the respective closure flaps 100*a*, 100*b*, 100*c*, and 100*d* of component 45 and when the closure flaps are folded inwardly to effect a closed top surface, the segments will effectively interleave with the closure flaps and retain the component 45 in assembled relation with the container. Strips of adhesive tape 101 may be applied to the top of component 45 so as to conceal the joints formed by the folded closure flaps. Thus, when the shipping unit is to be opened, the closure flaps of the component 45** are unfolded whereupon the latter may be removed endwise upwardly from the loaded container.

In lieu of the telescoping component 45, the container 33 may be a type such as a half slotted box with cover (HSC); a conventional regular slotted container (RSC); or a conventional overlap slotted container (OSC). In the latter two styles conventional top closure flaps are substituted for the segments **35*a*, 36*a*, 37*a* and 38*a***.

In loading the shipping unit 30, the following procedural steps are recommended: (a) the blank 34 in the collapsed state, shown in FIG. 2, is squared up and the closure flaps 42 folded so as to form a closed bottom whereby an open top container 33 is formed having a chamber C to accommodate a pair of chairs disposed in an inverted stacked relation; (b) set up blanks 48 and 50 into inner packing members 46, 47, respectively; (c) set up blank 83 into reinforcing piece 82 and insert the latter endwise into inner packing member 46; if desired, a second reinforcing piece may be inserted into inner packing member 47; (d) member 46 with the piece 82 assembled therein is placed in chamber C of the container 33 so as to rest upon the bottom of the container and against one side panel 37 thereof; the ends of the packing member 46 slidably engage side panels 36, 38; (e) when member 46 is properly positioned within the chamber C, the elongated pocket 70 and the pair of pockets 77, 78 face upwardly; (f) the chair 31 with the armrests is placed in an upright position within the chamber C with the ends of the front legs **31*b* being inserted into pockets 77, 78; (g) the upper inner packing member 47 is then placed into the chamber C with the upper end limit of the back section 31*d* of the chair 31 snugly accommodated in the elongated pocket 70 of the member 47; (h) the second chair 32 is placed in the chamber C in an inverted, stacked relation with respect to the upright chair 31 whereby the end of the depending back section 32*d* is inserted into the elongated pocket 70 formed in the lower packing member 46; when in place the depending back section 32*d* is disposed between, but spaced from, the front legs 31*b* of the upright chair 31 and the interior surface of the container side panel 37; (i) when the chairs 31, 32 are in inverted stacked relation, peripheral portions of the seat section 32*a* of the inverted chair 32 may rest upon the armrests of the upright chair 31; if desired, the armrests might be wrapped with a suitable protective material before the chair 32 is placed in the chamber; (j) in positioning the chair 32 in inverted relation with respect to chair 31, the upper ends of the front legs 32*b* are inserted in a substantially lateral direction into the spaced pockets 77, 78 of the upper inner packing member 47**;

(k) blank 93 is set up so that the wall panels 94–97 thereof are squared up to form a sleeve and then the lower end of the sleeve is slipped endwise over the open top of the container 33; and (l) the closure flaps 100*a*–100*d* of the sleeve and the projecting segments 35*a*, 36*a*, 37*d* and 38*d* of the container 33 are folded together so as to close the top of the container; strips of sealing tape 101 are then applied to the closed top; the bottom of the container had been previously sealed with strips of tape when the container was set up from blank 34. Where container is an RSC or OSC style, the steps (k) and (l) are omitted and in place thereof the top closure flaps are folded relative to one another and secured in a top closing relation.

Once the container is loaded and assembled with the component as above-described, the stacked chairs are firmly held in place within the shipping unit and are effectively protected during handling or storage of the loaded unit. As previously noted, the aforedescribed unit may be utilized to accommodate a single chair disposed in an upright position within the container.

It should be noted that no special tools or staples are required to assemble the various parts of the units. Furthermore, the size of the chamber C is such that there is a minimal amount of wasted space when the stacked chairs are positioned therein. The blanks for the various parts of the unit may be formed from inexpensive, yet sturdy, double-faced corrugated material and when the parts are not in use they may be readily stored in a collapsed state. The stacking strength of the loaded shipping unit is substantially improved by reason of the side and wall panels and the accommodated chairs do not bear the weight of the various units which might be stacked thereabove.

I claim:

1. A shipping unit for a pair of chairs arranged in an inverted stacked relation, each chair having a seat portion, an upwardly extending back portion, and supporting front and back legs depending from the seat portion, said unit comprising a container formed from a blank of foldable sheet material and including a plurality of foldably connected upright side panels and at least a plurality of bottom closure flaps connected to corresponding bottom edges of said side panels, said flaps and panels coacting to form a chamber having a closed bottom and upright walls, the height of the chamber walls being at least as great as the height of the pair of stacked inverted chairs; a first inner packing member disposed within said chamber and resting upon said bottom, said first member engaging the lower interior surfaces of one side panel and a pair of side panels extending angularly from opposite side edges of said one panel, said first member being provided with first means spaced inwardly from said one side panel for snugly accommodating a segment of the back portion of the inverted one of the pair of chairs and second means spaced inwardly from said one side panel a greater distance than said first means for snugly accommodating segments of the front legs of the upright one of the pair of chairs whereby the accommodated front legs of the upright chair and the accommodated segment of the back portion of the inverted chair are retained in relatively spaced relation to each other and to the chamber upright walls; a second inner packing member disposed within the chamber adjacent the top thereof, said second member engaging the upper interior surfaces of an opposing side panel disposed opposite said one side panel and a pair of side panels extending angularly from opposite side edges of said opposing side panel, said second member being provided with a third means spaced inwardly from said opposing side panel for snugly accommodating a segment of the back portion of the upright chair and fourth means spaced inwardly from said opposing side panel a greater distance than said third means for snugly accommodating segments of the front legs of the inverted chair whereby the accommodated front legs of the inverted chair and the accommodated back portion of the upright chair are retained in relatively spaced relation to each other and to the chamber upright walls; and means for closing the top of said chamber and engaging the second inner packing member.

2. The shipping unit of claim 1 wherein said inner packing members are positioned within diagonally disposed upper and lower elongated corners formed within said chamber.

3. The shipping unit of claim 1 wherein the corresponding side panels of the pairs of angularly extending side panels engaged by the inner packing members comprise a common side panel of the container.

4. The shipping unit of claim 1 wherein the first and third means of the inner packing members are elongated pockets and each inner packing is formed from a blank of foldable sheet material.

5. The shipping unit of claim 4 wherein each inner packing member includes an elongated tubular first section engaging at least three adjacent side panels forming said chamber, said first section being provided with said elongated pocket, and a tubular second section contiguous to and substantially coextensive with said first section, said second section being provided with a pair of longitudinally spaced pockets through which end segments of the front legs of one accommodated chair are adapted to extend, the pockets in said second section being spaced from the elongated pocket in said first section and from the side panels forming the chamber.

6. The shipping unit of claim 1 wherein the means for closing the top of said chamber includes a telescoping member formed from a blank of foldable sheet material and having a plurality of foldably connected wall panels and a closed top, said wall panels snugly embracing and slidably engaging the container said panels; the closed top of said telescoping member being supportingly engaged by the upper edges of said container side panels and in contact with the second inner packing member.

7. The shipping unit of claim 4 wherein at least the first inner packing member includes an elongated tubular section provided with the elongated pocket for snugly accommodating a segment of the back portion of the inverted chair and an elongated reinforcing element slidably mounted within said tubular section, said reinforcing element having an elevated top portion adapted to subtend and supportingly engage the segment of the inverted chair back portion accommodated within the elongated pocket formed in said first inner packing member whereby the accommodated segment of the inverted chair back portion is spaced from the chamber closed bottom.

8. The shipping unit of claim 7 wherein said first inner packing member and said reinforcing element are provided with complemental locking means for retaining said member and element in a predetermined assembled relation.

9. The shipping unit of claim 5 wherein each inner packing unit is provided with self-locking means for retaining said tubular sections in predetermined fixed relation.

* * * * *

UNITED STATES PATENT AND TRADEMARK OFFICE

CERTIFICATE OF CORRECTION

PATENT NO. : 4,170,297

DATED : October 9, 1979

INVENTOR(S) : Charles H. Johnson

It is certified that error appears in the above-identified patent and that said Letters Patent are hereby corrected as shown below:

Column 8, line 42 - "said" should be -- side --

Signed and Sealed this

Fourth Day of March 1980

[SEAL]

Attest:

SIDNEY A. DIAMOND

Attesting Officer

Commissioner of Patents and Trademarks